US005380215A

United States Patent [19]

Huang

[11] Patent Number: 5,380,215

[45] Date of Patent: Jan. 10, 1995

[54] SECURE LAMP BASE

[76] Inventor: Ming H. Huang, 2, Lane 65, Cheng Kon Road, Hsinchu, Taiwan, Prov. of China

[21] Appl. No.: 177,366

[22] Filed: Jan. 5, 1994

[51] Int. Cl.[6] ..... H01R 13/54

[52] U.S. Cl. ..... 439/340; 439/419

[58] Field of Search ..... 439/340, 336, 419, 414, 439/602, 605, 613, 614, 616, 619, 637, 59, 62, 660

[56] References Cited

U.S. PATENT DOCUMENTS

| | | | |
|---|---|---|---|
| 701,680 | 6/1902 | Chase | 439/340 X |
| 2,647,246 | 7/1953 | Gilbert | 439/419 |
| 3,530,422 | 9/1970 | Goodman | 439/59 |
| 3,597,725 | 8/1971 | Beck et al. | 439/419 |
| 3,671,917 | 6/1972 | Ammon et al. | 439/62 |
| 3,729,700 | 4/1973 | Johnson et al. | 439/602 |
| 3,757,277 | 9/1973 | Yamanoue et al. | 439/660 |
| 3,783,435 | 1/1974 | Fisher | 439/340 |
| 4,159,157 | 6/1979 | Koehler | 439/419 X |
| 5,137,454 | 8/1992 | Baechtle | 439/637 |
| 5,306,173 | 4/1994 | Suzuki | 439/336 |

FOREIGN PATENT DOCUMENTS

| | | | |
|---|---|---|---|
| 598671 | 5/1960 | Canada | 439/419 |
| 2370373 | 7/1978 | France | 439/336 |
| 903585 | 8/1962 | United Kingdom | 439/602 |

*Primary Examiner*—William Briggs

*Attorney, Agent, or Firm*—Morton J. Rosenberg; David I. Klein

[57] ABSTRACT

A secure lamp base includes an improved base which is provided with a slot having a bottom channel, and a groove is formed on the projection of the base. A pair of conductive slices have their inner ends to be a hook having two sideways tips, the hook of a conductive slice is inserted into the channel and the other is engaged with the groove, that provides a firmly engagement between the conductive slices and the base and promises a well electrical connection when the base receives a lamp from its opened side.

1 Claim, 5 Drawing Sheets

SECURE LAMP BASE

BACKGROUND OF THE INVENTION

In prior art structure, a base (5), as a shell, receives a lamp at its opened side and a pair of conductive slices (6), (7) which are inserted into the base from two grooves on the closed side of the base. As shown in FIG. 5, the prior assembly of the lamp and the base, it can be seen that one conductive slice (6) leans against the inner wall of the base (5) and the other slice (7) has its inner end being folded to a perpendicular manner. Since the conductive slice (6) may not lean closely against the wall of the base (5), such as in the position of the dot line of FIG. 5, it could disturb the procedure of assembling the lamp into the base (5). And the perpendicular part of the slice (7) is possibly inclined, that contacts the head of the lamp which might not be a well engaged situation.

SUMMARY OF THE INVENTION

It is an object of the present invention to mitigate and/or obviate the above-mentioned drawbacks of prior art controllers in the manner set forth in the description of the preferred embodiment.

A primary object of the present invention is to provide a secure lamp base for obtaining a complete engagement between the lamp and conductive slices within the base, that provides a safe electrical connection.

Further objects and advantages of the present invention will become apparent as the following description proceeds, and the features and novelty are characterized in the claims annexed to and forming a part of this invention

DESCRIPTION OF THE PREFERRED EMBODIMENTS

Figure 1:
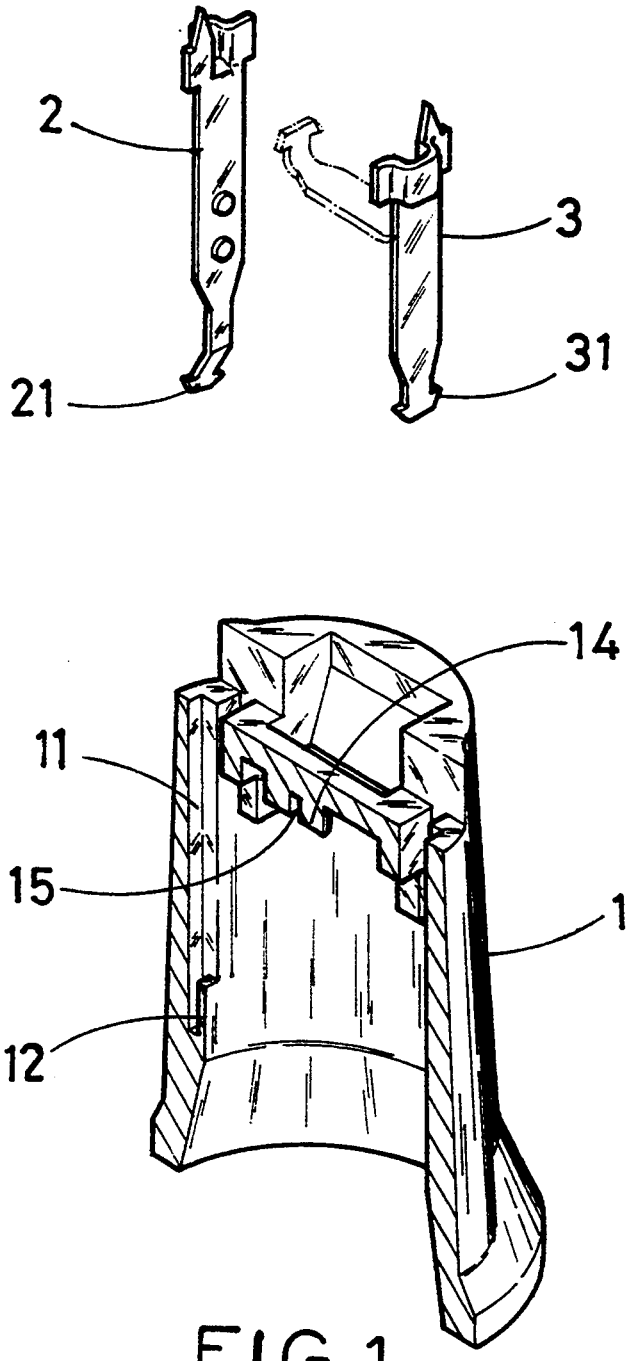
FIG. 1 is a perspective and semi-crossed view showing a pair of conductive slices and the base in accordance to the present invention.
Figure 2:
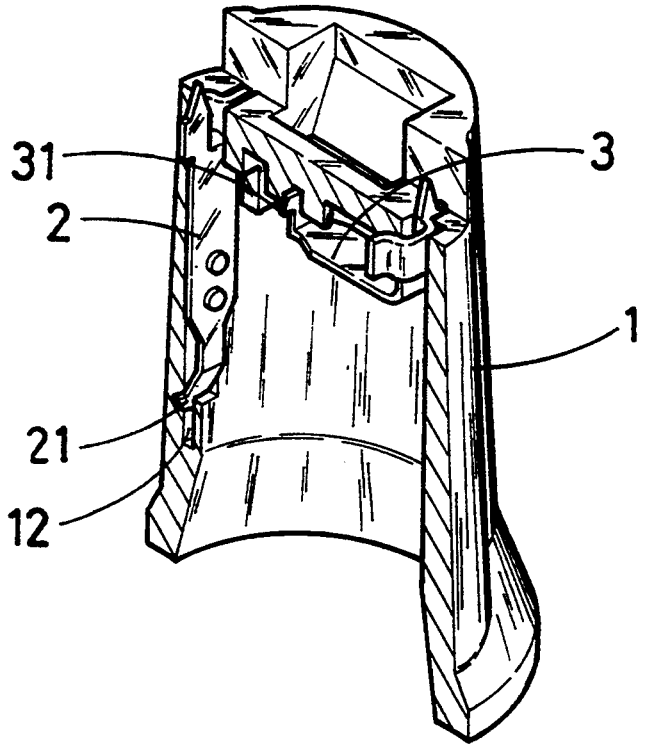
FIG. 2 is a assembled perspective view of FIG. 1.
Figure 3:
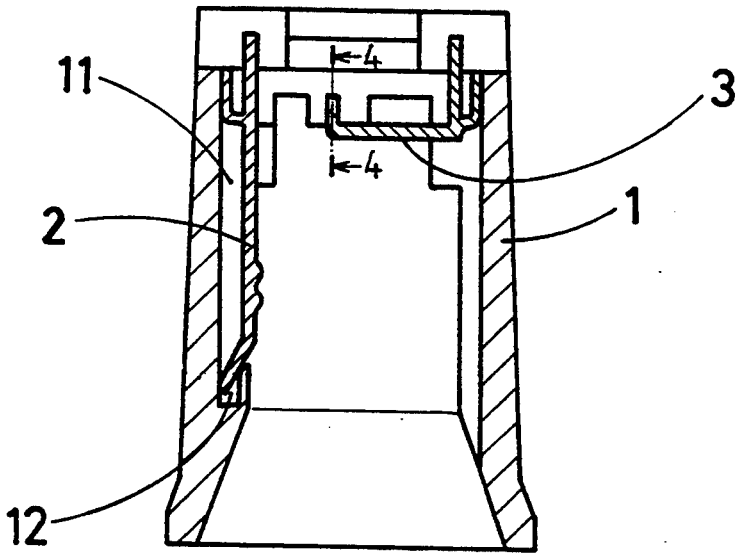
FIG. 3 is a cross-sectional view of the present invention.

Referring to FIGS. 1 and 2, it can be seen that the present invention includes an improved base (1) and a pair of conductive slices (2), (3), wherein a long slot (11) is provided in the inner wall of the base (I) and the bottom of the slot (11) is a channel (12). The projection (14) in the base (1) is provided with another groove (15). The inner end of the conductive slice (2) or (3) is formed to be a hook (21) or (31), which extends its two tips sideways.

Figure 4:
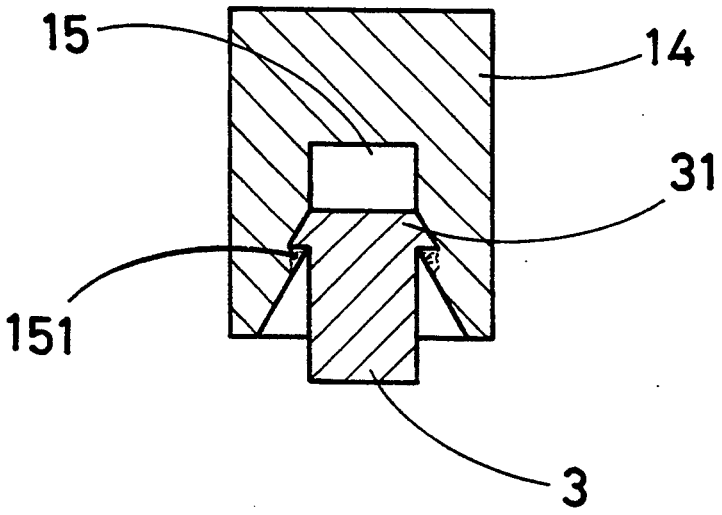
FIG. 4 is a cross-sectional view along Line 4—4 of FIG. 3.
Figure 5:
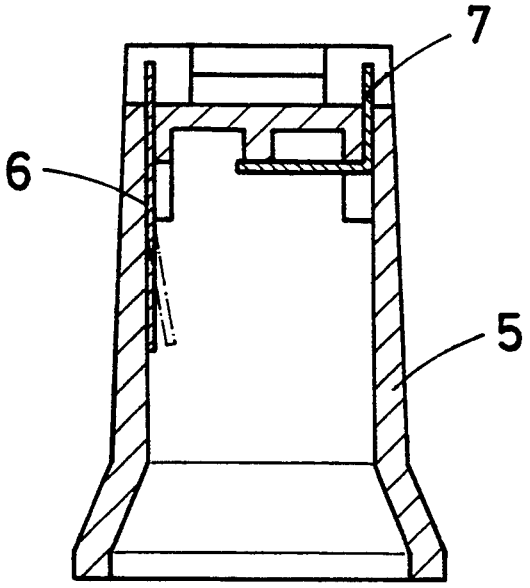
FIG. 5 (PRIOR ART)
FIG. 5 is a cross-sectional view of a prior art assembly.

The conductive slice (2) leans against the slot (11) and the hook (21) is engaged in the channel (12). The hook (31) is folded and inserted into the groove (15) on the projection (14) that obtains a secure engagement therebetween, as shown in FIG. 4.

Because the two conductive slices (2) and (3) are firmly fixed in the base (1), it will be understood that the assembly with the lamp is secure and easy to be done while a well electrical connection can be promised.

As various possible embodiment might be made of the above invention without departing from the scope of the invention, it is to be understood that all matter herein described or shown in the accompanying drawings is to be interpreted as illustrative and not in a limiting sense. Thus, it will be appreciated that the drawings are exemplary of a preferred embodiment of the invention.

I claim:

1. A secure lamp base including:

a base having a slot along its inner wall and the bottom of the slot being a channel; a projection in the base being provided with groove, and a pair of conductive slices both having the inner end to be a hook which entends its two tips sideways; one of the conductive slices leaning against the slot and its hook engaging in the channel of the base, while the other slice has its hook end folded and inserted into the groove on the projection in the base for obtaining a firm engagement therebetween.

* * * * *